US012214408B2

(12) United States Patent
Crush et al.

(10) Patent No.: US 12,214,408 B2
(45) Date of Patent: Feb. 4, 2025

(54) RAM ASSEMBLY WITH REMOVABLE PUNCH MOUNTING ASSEMBLY

(71) Applicant: Stolle Machinery Company, LLC, Centennial, CO (US)

(72) Inventors: Kelley Andrew Crush, Arvada, CO (US); Nicholas Schultz, Evergreen, CO (US); Luke Wayne Jacobson, Arvada, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 54 days.

(21) Appl. No.: 18/106,763

(22) Filed: Feb. 7, 2023

(65) Prior Publication Data

US 2023/0182196 A1 Jun. 15, 2023

Related U.S. Application Data

(63) Continuation of application No. 17/019,408, filed on Sep. 14, 2020, now Pat. No. 11,597,001, which is a continuation of application No. 15/621,541, filed on Jun. 13, 2017, now Pat. No. 10,792,725.

(51) Int. Cl.

| | |
|---|---|
| ***B21D 51/26*** | (2006.01) |
| ***B21D 22/28*** | (2006.01) |
| ***B21D 22/30*** | (2006.01) |

(52) U.S. Cl.
CPC ..... *B21D 51/26* (2013.01); *B21D 22/283* (2013.01); *B21D 22/30* (2013.01)

(58) Field of Classification Search
CPC ..... B21D 22/28; B21D 22/283; B21D 22/30
USPC ..... 72/343, 347, 478, 479, 481.1, 72/481.3–481.9, 267
See application file for complete search history.

(56) References Cited

U.S. PATENT DOCUMENTS 2,877,546 A * 3/1959 Wilcox ..... B21D 22/21 72/347
2016/0121385 A1* 5/2016 Butcher ..... B21D 24/00 413/69

FOREIGN PATENT DOCUMENTS

EP 0584789 A1 * 3/1994 ..... B21D 22/30

* cited by examiner

*Primary Examiner* — Jared O Brown
(74) *Attorney, Agent, or Firm* — Eckert Seamans Cherin & Mellott, LLC

(57) ABSTRACT

An assembly includes an elongated ram body and a punch mounting assembly. The ram body has a reduced length. The punch mounting assembly includes an elongated body having a complementary length. The punch mounting assembly is coupled to the ram body. The assembled punch mounting assembly and ram body have an operational length.

9 Claims, 7 Drawing Sheets

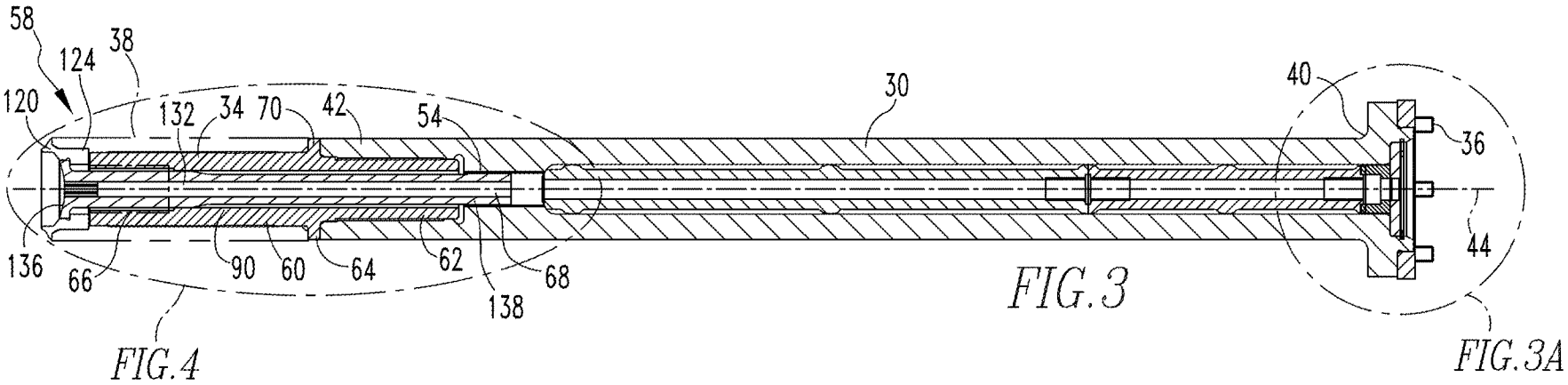
FIG. 3A
FIG. 3
FIG. 4
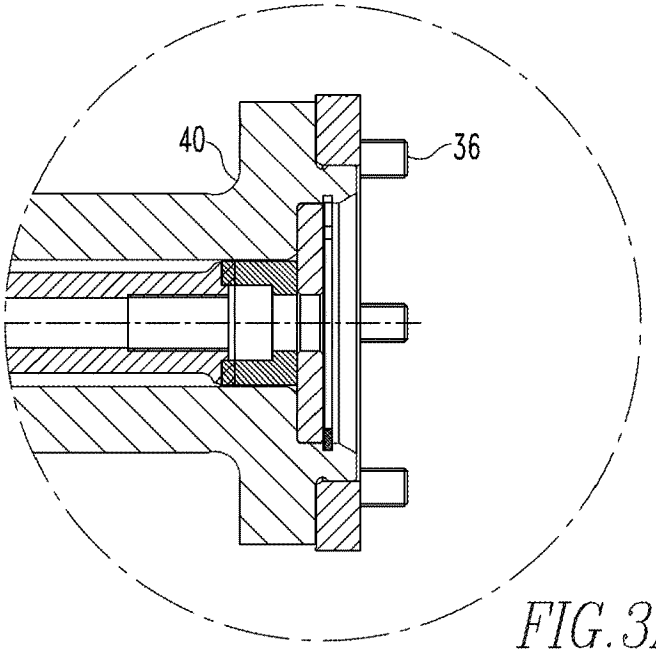
FIG. 3A

RAM ASSEMBLY WITH REMOVABLE PUNCH MOUNTING ASSEMBLY

CROSS REFERENCE TO RELATED APPLICATIONS

This application is a continuation application of and claims priority to U.S. patent application Ser. No. 17/019,408, filed Sep. 14, 2020, which application is a continuation application of U.S. patent application Ser. No. 15/621,541, filed Jun. 13, 2017, now U.S. Pat. No. 10,792,725.

FIELD OF THE INVENTION

The disclosed and claimed concept relates to a ram assembly and, more particularly, to a ram assembly including a punch mounting assembly structured to be decoupled from a ram body whereby a punch mounted on the punch mounting assembly can be decoupled from the ram assembly without decoupling the ram assembly from a drive assembly.

BACKGROUND OF THE INVENTION

Generally, a can, such as but not limited to an aluminum can or steel can, begins as a sheet of metal from which a circular blank is cut. Hereinafter, the can will be described as being made from aluminum, but it is understood that the selection of material is not limiting upon the claims. The blank is formed into a "cup." As used herein, a "cup" includes a bottom and a depending sidewall. Further, while cups and the resulting can bodies may have any cross-sectional shape, the most common cross-sectional shape is generally circular. Accordingly, while it is understood that the cups and the resulting can bodies may have any cross-sectional shape, the following description shall describe the cups, can bodies, punches, etc. as being generally circular.

The cup is fed into a bodymaker including a drive assembly, a reciprocating ram and a number of dies. Generally, the drive assembly is operatively coupled to the ram assembly and moves the ram assembly between a retracted, first position wherein the ram assembly does not extend into the dies (or other assemblies, described below), and, an extended, second position wherein the ram assembly extends into the dies (or other assemblies). That is, the elongated ram includes a punch at the distal end. On each forward stroke of the ram, a cup is initially positioned in front of the ram. The cup is disposed over the forward end of the ram, and more specifically on the punch located at the front end of the ram. The cup is passed through a number of assemblies located at the forward end of the bodymaker. These assemblies, hereinafter and as used herein, "forward assemblies," include a domer assembly, a die pack, a redraw assembly, and a seal assembly. The seal assembly substantially removes lubricant and cooling fluid from the ram as it reciprocates. The redraw assembly, which is also identified as part of the die pack, includes a redraw die. The redraw die reshapes the cup so that the cup has a diameter generally the same as the resulting can body. The redraw die does not effectively thin the thickness of the cup sidewall. After passing through the redraw die, the ram moves through a tool pack having a number of ironing dies. More specifically, the die pack has multiple, spaced dies, each die having a substantially circular opening. Each die opening is slightly smaller than the next adjacent upstream die. Thus, as the cup passes through the ironing dies, the cup is elongated and the sidewall is thinned.

Further, the distal end of the punch is concave. At the maximum extension of the ram is the domer. The domer has a generally convex dome and a shaped perimeter. As the ram reaches its maximum extension, the bottom of the cup engages the domer. The bottom of the cup is deformed into a dome and the bottom perimeter of the cup is shaped as desired; typically angled inwardly so as to increase the strength of the can body and to allow for the resulting cans to be stacked. After the cup passes through the final ironing die and contacts the domer, it is a can body.

On the return stroke, the can body is removed from the punch. That is, as the ram moves backwardly through the tool pack, the can body contacts a stationary stripper which prevents the can body from being pulled backward into the tool pack and, in effect, removes the can body from the punch. Alternatively, or in addition to the stripper, the ram assembly includes a pneumatic system structured to apply pressurized fluid (gas) through the ram and punch to the interior of the can body. The pressurized fluid ejects the can body from the punch.

After the ram moves back to an initial position, a new cup is positioned in front of the ram and the cycle repeats. Following additional finishing operations, e.g., trimming, washing, printing, etc., the can body is sent to a filler which fills the can body with product. A top is then coupled to, and sealed against, the can body, thereby completing the can.

It is understood that due to the speed of the bodymaker and the narrow tolerances between the dies and the ram, the ram body must be precisely aligned with the die pack. Similarly, other elements coupled to the forward mounting assembly must be precisely positioned relative to the other elements of the bodymaker; if not, the ram/punch will contact the die pack, or other elements thereby damaging all the elements involved in the impact.

A problem with known ram assemblies is the length. That is, when the ram assembly is in the retracted, first position, which is also identified as the "back dead center" (or "BDC"), the end of the ram assembly, including the punch, extends past the seal assembly and into the redraw assembly/die pack. The seals and seal housing of the seal assembly are a one-piece ring-like construction. Thus, to replace the seals in the seal assembly, which is a common procedure, the seal assembly and the ram assembly must be decoupled. Because of the length of the ram assembly, however, this procedure is complicated and time consuming. That is, for example, to decouple the seal assembly and the ram assembly, the seal assembly must be moved over the end of the ram assembly. That is, typically the end of the ram assembly extends into the redraw assembly and it is impossible to simply slide the seal assembly off the end of the ram assembly with the ram assembly in place on the bodymaker.

Thus, to decouple the seal assembly and the ram assembly, one standard procedure calls for pushing the ram assembly towards the rear of the bodymaker and then removing the entire ram assembly. This procedure breaks the alignment of the ram assembly relative to the die pack and other elements. Alternatively, the ram assembly is decoupled from the drive assembly and pulled toward the front of the bodymaker. This procedure also breaks the alignment of the ram assembly relative to the die pack and other elements. Thus, after the seals are replaced, the ram assembly must be recoupled to the bodymaker/drive assembly, and realigned with the die pack and other components. This procedure typically takes several hours and often performed by multiple technicians. This is a problem.

One attempt to solve this problem provided an intermediate coupling between the punch and the ram body. Such an intermediate coupling, however, was machined for a single ram and a single punch. That is, the intermediate coupling was machined to match a single ram and a single punch. Further, the intermediate coupling utilized a two-part punch. That is, the punch was divided into a nose and an ironing body. These elements also were machined to mate in a specific orientation. Thus, these elements needed to be specifically oriented prior to operation and, therefore, needed an orientation device/assembly. For example, the intermediate coupling included a number of dowel couplings (pins and bores) so that the intermediate coupling could be oriented on the ram body, and, so that the punch could be oriented on the intermediate coupling. Further, the punch and the intermediate coupling had a greater radius than the associated ram.

This solution also presented several problems. First, the machining of an intermediate coupling for a single ram and a single punch was time consuming and expensive. Further, the need to orient the intermediate coupling to the ram body, and the punch to the intermediate coupling, is time consuming. Further, the need to couple several elements to each other, i.e., punch nose to ironing body, punch assembly to intermediate coupling, and intermediate coupling to ram body, was time consuming and was a problem. Further, having the ram body more narrow than the punch assembly and intermediate coupling could allow for unexpected torque/stress at the interface of the intermediate coupling and the ram body. Further, the intermediate coupling and the ram body needed a minimal thickness to allow for the axial passages/threaded bores for the fasteners. This thickness required the intermediate coupling and the ram body to be heavy.

That is, there is a need for a bodymaker wherein seals in the seal assembly can be replaced without having to remove the ram assembly then reinstall and realign the ram assembly. There is a further need for any new assembly to be compatible with existing bodymakers, punches, die packs etc.

SUMMARY OF THE INVENTION

These needs, and others, are met by at least one embodiment of the disclosed and claimed concept which provides a ram assembly including an elongated ram body and a punch mounting assembly. The ram body has a reduced length. The punch mounting assembly includes an elongated body having a complementary length. The punch mounting assembly is coupled to the ram body. The assembled punch mounting assembly and ram body have an operational length.

That is, as used herein, a ram body with a "reduced length" means that the ram body has a length such that when the ram assembly is in the retracted, first position, or BDC, the ram body does not extend into the die pack and/or redraw assembly. Further, as used herein, a ram body with a "very reduced length" means that the ram body has a length such that when the ram assembly is in the retracted, first position, or BDC, the ram body does not extend into the seal assembly. Further, as used herein, an "operational length" for a ram assembly means that the ram assembly has a sufficient length so that, when the ram assembly is in the extended, second position, the ram assembly causes a cup to engage the domer assembly, or, causes the cup to pass through the die pack if there is no domer assembly. Further, as used herein, a "complementary length" for a punch mounting assembly means that the punch mounting assembly has a length such that, when the punch mounting assembly is coupled to a ram body with a "reduced length," or a "very reduced length," the combined length of the ram body and punch mounting assembly is the "operational length" for the ram assembly.

In this configuration, the replacement of seals in the seal assembly includes decoupling a ram body and a punch mounting assembly, removing either the punch mounting assembly or the ram body from a ram passage defined by the seals, and replacing the seals. Further, the configuration of the punch mounting assembly, as well as the ram assembly and the punch assembly, discussed below, solves the problems stated above.

BRIEF DESCRIPTION OF THE DRAWINGS

A full understanding of the invention can be gained from the following description of the preferred embodiments when read in conjunction with the accompanying drawings in which:

FIG. 3 is a cross-sectional side view of a ram assembly. FIG. 3A is a detail cross-sectional side view of a ram assembly first end.

DETAILED DESCRIPTION OF THE INVENTION

Figure 1:
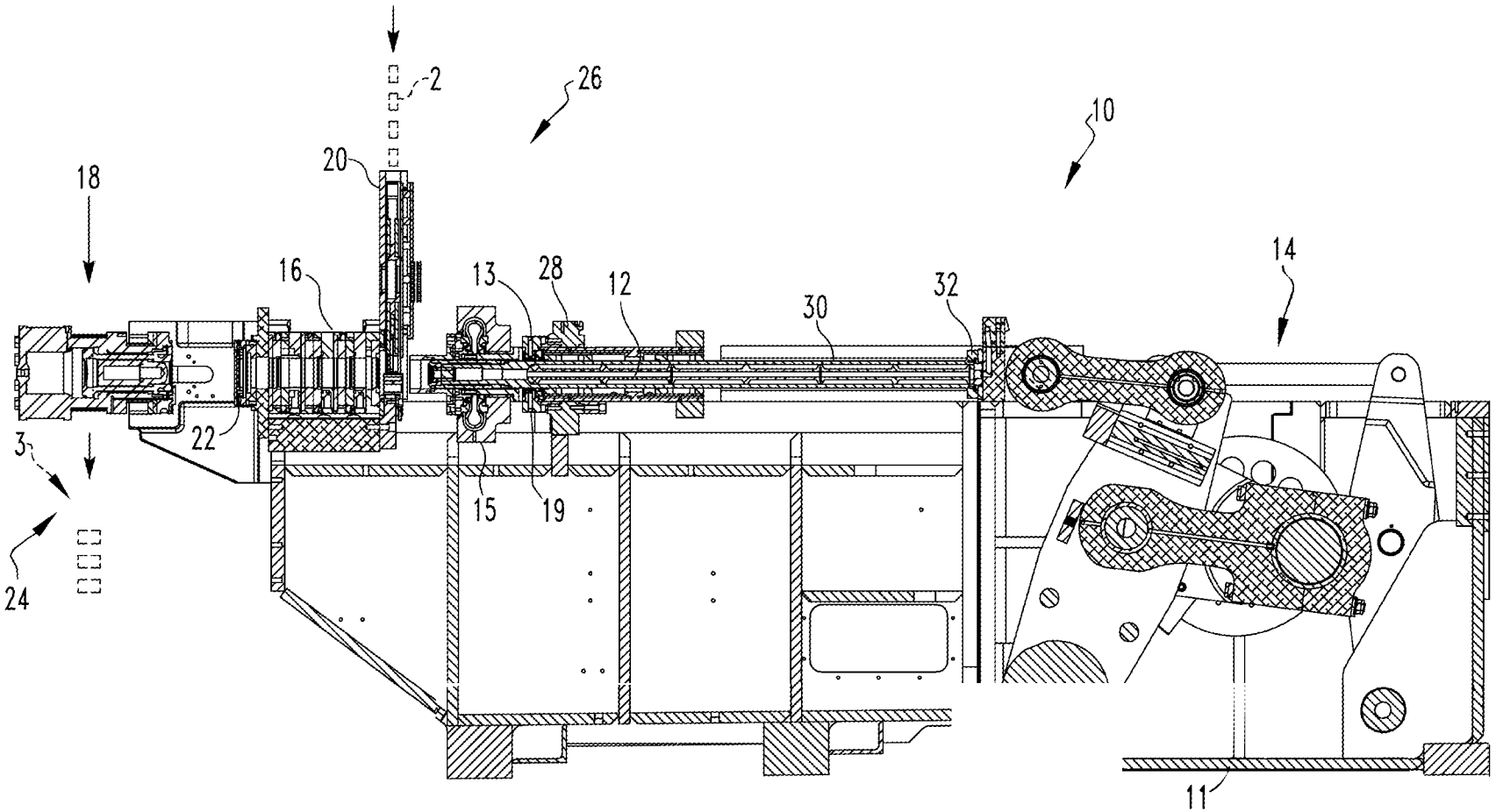
FIG. 1 is a partially schematic, cross-sectional side view of a bodymaker.
Figure 2:
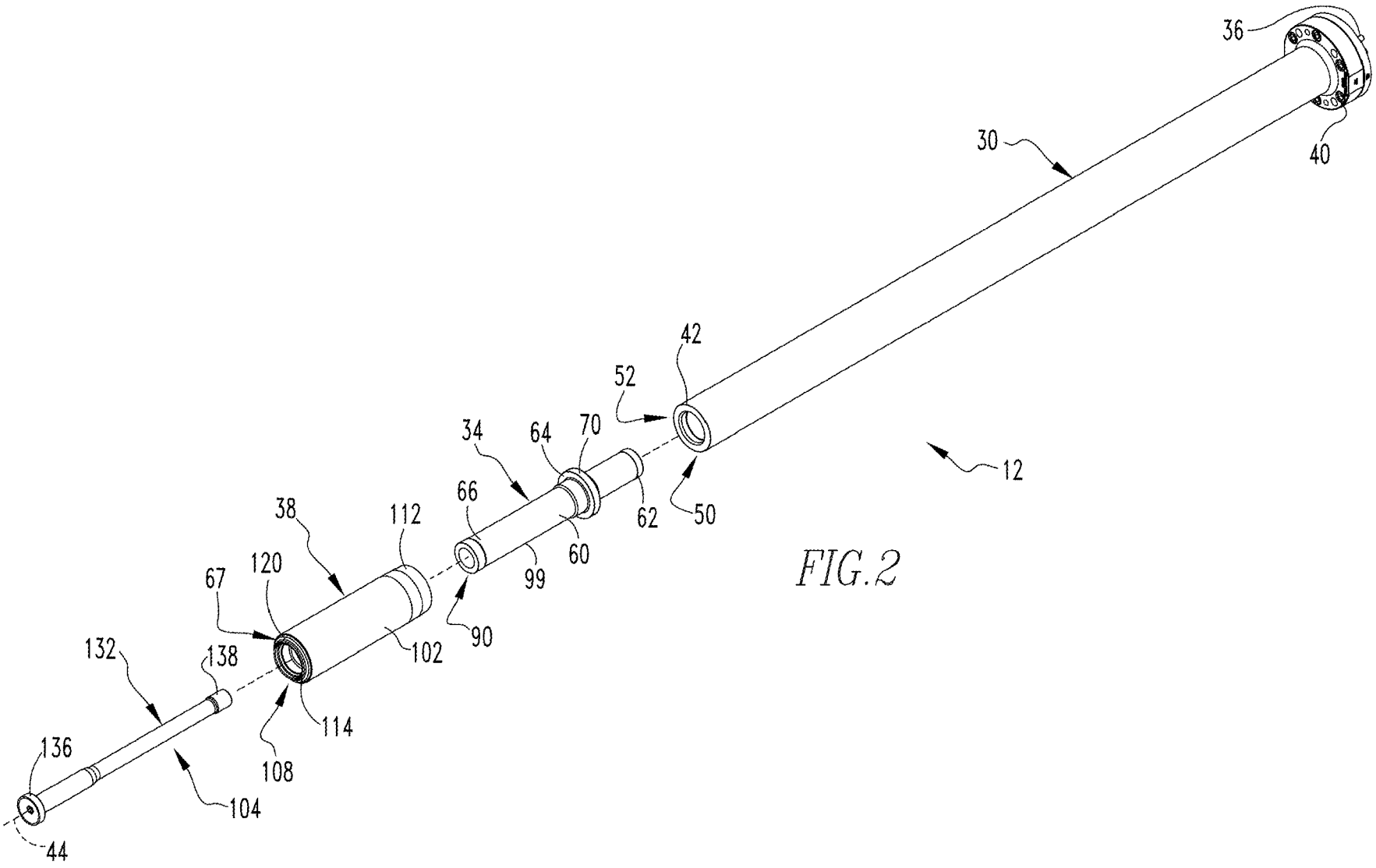
FIG. 2 is a partially exploded, isometric view of a ram assembly.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As described below, a bodymaker 10 includes an elongated reciprocating ram assembly 12 and a domer assembly 18. As used herein, the domer assembly 18 is disposed at the "forward" end of the bodymaker 10. As used herein, when the ram assembly 12 is adjacent the domer assembly 18, the ram assembly 12 is at the "forward" end of its stroke. As used herein, the "rear" or "back" end of the bodymaker 10 is disposed opposite the "forward" end. Further, as used herein, the bodymaker 10 has a "longitudinal" direction that is parallel to the longitudinal axis of the ram assembly body 30, described below, as well as a "lateral" direction that is generally horizontal and perpendicular to the "longitudinal" direction.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is resting on a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening is made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces. The perimeter, and therefore the edge surface, may include generally straight portions, e.g., as on a rectangular planar member, or be curved, as on a disk, or have any other shape.

As used herein, a "path of travel" or "path," when used in association with an element that moves, includes the space an element moves through when in motion. As such, any element that moves inherently has a "path of travel" or "path."

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately." i.e., in an approximate range relevant to the measurement as would be understood by one of ordinary skill in the art.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can.

As used herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and soda cans, as well as food cans.

As used herein, "generally curvilinear" includes elements having multiple curved portions, combinations of curved portions and planar portions, and a plurality of planar portions or segments disposed at angles relative to each other thereby forming a curve.

As used herein, a "contour" means the line or surface that defines an object. That is, for example, when viewed in cross-section, the surface of a three-dimensional object is reduced to two dimensions; thus, a portion of a three-dimensional surface contour is represented by a two-dimensional line contour.

As used herein, a "perimeter portion" means the area at the outer edge of a defined area, surface, or contour.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and near relevant to the term being modified as would be understood by one of ordinary skill in the art.

As shown in FIG. 1, a can bodymaker 10 is structured to convert a cup 2 into a can body 3. A cup 2 has a bottom member with a depending sidewall defining a substantially enclosed space (none identified by reference number). The end of the cup 2 opposite the bottom is open. The can bodymaker 10, in an exemplary embodiment, includes a housing or frame assembly 11 (hereinafter "frame assembly" 11) a reciprocating, elongated ram assembly 12, a drive assembly 14, a seal assembly 13, a redraw assembly 15, a die pack 16, a domer assembly 18, a cup feeder 20 (shown schematically), a stripper assembly 22 (shown schematically), and a take-away assembly 24. As used herein, the redraw assembly 15 and the die pack 16 are collectively identified as the "forward assemblies" 26. The seal assembly 13 includes a number of toroidal seals 19 (hereinafter "seal assembly seals" 19). The seal assembly seals 19 define a portion of the ram body path of travel. In an exemplary embodiment, the can bodymaker 10 also includes a guide assembly 28. The guide assembly 28 includes a bearing or similar construct (not shown). The guide assembly 28 is disposed between the forward assemblies 26 and the carriage 32 (discussed below) at the forward end of the carriage path of travel.

The drive assembly 14 is coupled to the frame assembly 11 and operatively coupled to the ram assembly 12 and, in an exemplary embodiment, to the carriage 32. The drive assembly 14 is structured to, and does, impart a reciprocating motion to the ram assembly 12 causing the ram assembly 12 to reciprocate in a direction generally parallel to, or along, the longitudinal axis of the ram assembly 12.

The ram assembly 12, in an exemplary embodiment, includes a number of elements, such as a guide assembly, cooling assembly, and/or a cup ejector assembly (none shown), that are not relevant to the present disclosure. It is noted, however, that a ram assembly, cooling assembly, and/or a cup ejector assembly include passages within the ram assembly body 30. For the purpose of this disclosure, and as shown in FIGS. 2-5, elements of the ram assembly 12 include an elongated ram assembly body 30 (alternatively, and as used herein, a "ram body" 30), a carriage 32 (FIG. 1), a punch mounting assembly 34, a number of couplings 36 and a punch assembly 38. That is, the ram assembly 12 includes an elongated, substantially circular body 30 with a proximal, first end 40, a distal, second end 42, and a longitudinal axis 44. In an exemplary embodiment, the ram body 30 has a "reduced length" or a "very reduced length" as defined above.

The carriage 32 includes a ram body first coupling component(s) such as, but not limited to a number of threaded bores (none shown). As is known, the coupling between the carriage 32 and the ram body 30, and/or the coupling between the carriage 32 and the frame assembly 11, include adjustment devices such as, but not limited to shims (none shown). The adjustment devices are used to align the ram body 30, and therefore the ram assembly 12, with the forward assemblies 26. As used herein, an "aligned" ram body 30 (or ram assembly 12) means that the ram body is aligned with the forward assemblies 26 and is ready for operation.

The ram body first end 40 includes a ram body second coupling component(s) 36 (FIG. 3A) that is/are structured to, and is/are, coupled, directly coupled, or fixed to the carriage ram body first coupling component(s). That is, in an exemplary embodiment, the ram body second coupling component(s) is/are fasteners structured to be coupled to threaded bores (none shown). It is understood that this coupling is a temporary coupling and that this embodiment is only exemplary and other configuration are common. The ram body second end 42 includes a punch mounting assembly first coupling component 50. The ram body punch mounting assembly first coupling component 50 (hereinafter "punch mounting assembly first coupling component" 50) is structured to be, and is, coupled, directly coupled, or fixed to the punch mounting assembly 34, as described below. In an exemplary embodiment, the punch mounting assembly first coupling component 50 includes a landing bore 52 and a threaded bore 54 (hereinafter, "ram body second end threaded bore" 54), both of which extend along the ram body longitudinal axis 44. As used herein, a "landing bore" is an elongated bore machined so that the sidewall defining the bore is substantially aligned with the ram body longitudinal axis 44 and which has a substantially smooth surface. Thus, the landing bore 52 has a longitudinal axis 56 that is substantially aligned with the ram body longitudinal axis 44. The landing bore 52 is disposed at an axial surface of the ram body second end 42. The ram body second end threaded bore 54 is contiguous with the landing bore 52 and is disposed closer to the ram body first end 40. In an exemplary embodiment, not shown, the ram body 30 includes passages for a cooling assembly, and/or a cup ejector assembly. The punch mounting assembly 34 also includes a punch first coupling component 58, as discussed below. The punch first coupling component 58 is structured to be, and is, coupled, directly coupled, or fixed to a punch second coupling component 106, discussed below.

As shown in FIGS. 2, 3-4 and 6, the punch mounting assembly 34 is structured to, and does, support the punch assembly 38. The punch mounting assembly 34 includes an elongated body 60 having a "complementary length" relative to the ram body 30. The punch mounting assembly body 60 (also identified as, and as used herein, the "mounting body" 60) includes a first end 62, a medial portion 64, a second end 66, and a longitudinal axis 68. As used herein, the "punch mounting assembly body first end 62" extends from the axial surface/side of the punch mounting assembly body first end 62 to a location adjacent a punch mounting assembly body medial portion flange 70, discussed below. Similarly, the "punch mounting assembly body second end 66" extends from the axial surface/side of the punch mounting assembly body second end 66 to a location adjacent a punch mounting assembly body medial portion flange 70. In an exemplary embodiment, the punch mounting medial portion 64 defines a flange 70 that is a radially extending flange 70 as shown or a rearwardly facing flange (not shown)defined by the punch mounting assembly body first end 62 having a reduced radius. That is, the punch mounting assembly body first end 62 has a first radius and the punch mounting assembly body second end 66 has a second radius. In an exemplary embodiment, the punch mounting assembly body first radius is smaller than the punch mounting assembly body second radius.

The punch mounting assembly body first end 62 defines a punch mounting assembly second coupling component 72. The punch mounting assembly second coupling component 72 is structured to be, and is, coupled, directly coupled, or fixed to the punch mounting assembly first coupling component 50. In an exemplary embodiment, the punch mounting assembly second coupling component 72 includes a reduced radius portion 74 of the punch mounting assembly body 60 (also identified as, and as used herein, the "reduced radius portion" 74). In an exemplary embodiment, the reduced radius portion 74 is a landing 76. As used herein, a "landing" is an elongated construct having an outer surface that is substantially parallel to an associated longitudinal axis as well as a substantially smooth surface. Thus, the punch mounting assembly landing 76 has a longitudinal axis 78 that extends substantially parallel to the punch mounting assembly body longitudinal axis 68. Further, as used herein, a "landing" is sized and shaped to closely correspond to an associated "landing bore" so that, when the landing is inserted into the associated "landing bore" the landing longitudinal axis 78 and the landing bore 52 longitudinal axis 56 are substantially aligned. Further, as used herein, because a "landing" and a "landing bore" so closely correspond to each other, the elements coupled by the landing/landing bore are automatically aligned with each other regardless of the orientation of the elements relative to each other. That is, when aligning elements coupled by a landing and landing bore, no further alignment or orienting procedure/device is required other than coupling the landing and landing bore. Thus, use of a landing and landing bore to couple a punch assembly 38 to a ram body 30 solves the problems stated above.

Further, use of a landing as disclosed herein, does not require the use of axially extending fasteners to couple the punch mounting assembly 34 to the ram body 30. This means that the body of the punch mounting assembly 34 does not have to be sufficiently thick to allow for the fastener passages/threaded bores. Accordingly, the punch mounting assembly 34 is a "reduced mass" punch mounting assembly 34. That is, a body that does not include passages/threaded bores for common fasteners may be thinner than a body that does include such fastener passages/threaded bores and therefore is, as used herein, a "reduced mass" body. Further, as used herein, the punch retainer bolt 132, discussed below, is not a common fastener.

In an embodiment with a radially extending flange 70, both the punch mounting assembly body first radius and the punch mounting assembly body second radius are smaller than a radially extending flange 70 radius. In this configuration, and in an exemplary embodiment, the radius of the radially extending flange 70 (i.e., the punch mounting assembly 34), the ram body 30, and the punch assembly 38 are substantially similar. In this configuration, no element is thinner relative to other elements. This reduces the likelihood of the ram assembly generating unusual stresses and torques, thereby solving the problems stated above.

Figure 4:
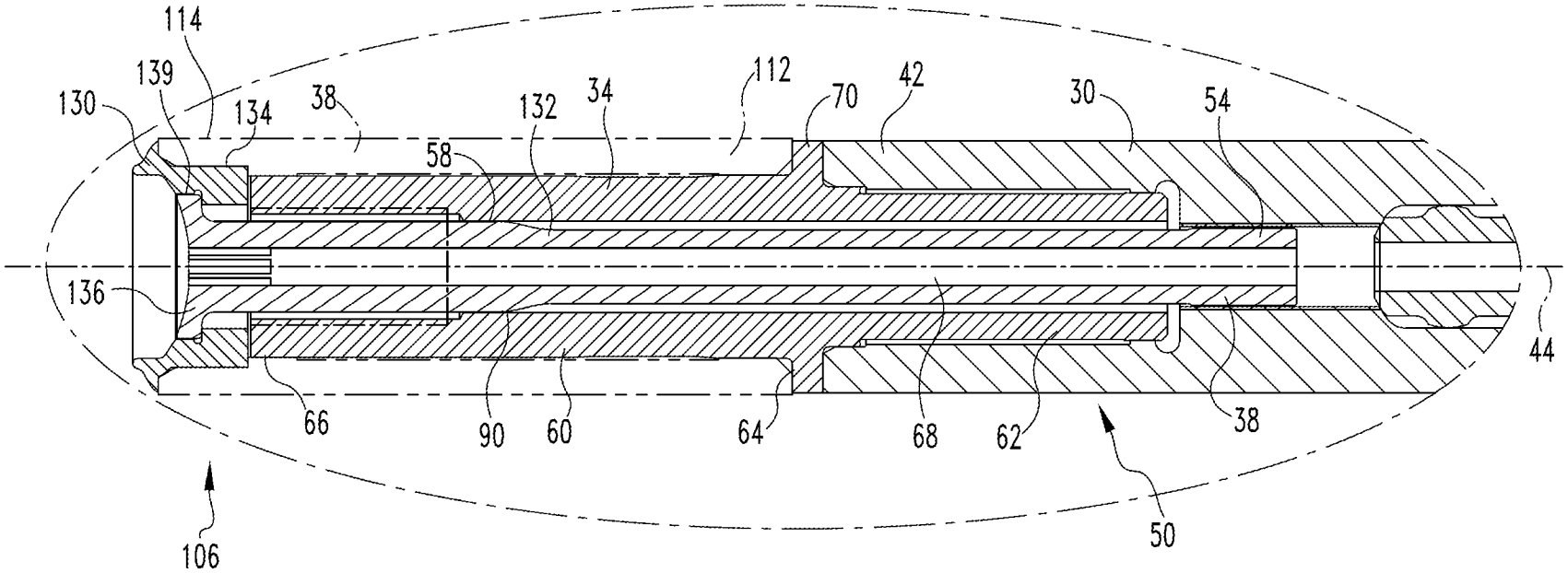
FIG. 4 is a detail cross-sectional side view of a ram assembly second end.
Figure 5:
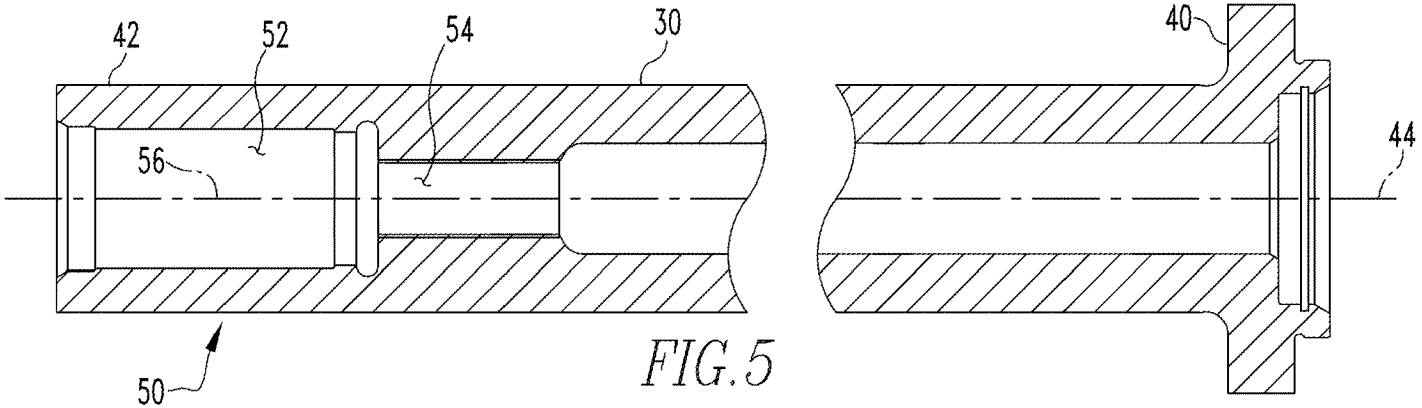
FIG. 5 is a cross-sectional side view of a ram body.
Figure 6:
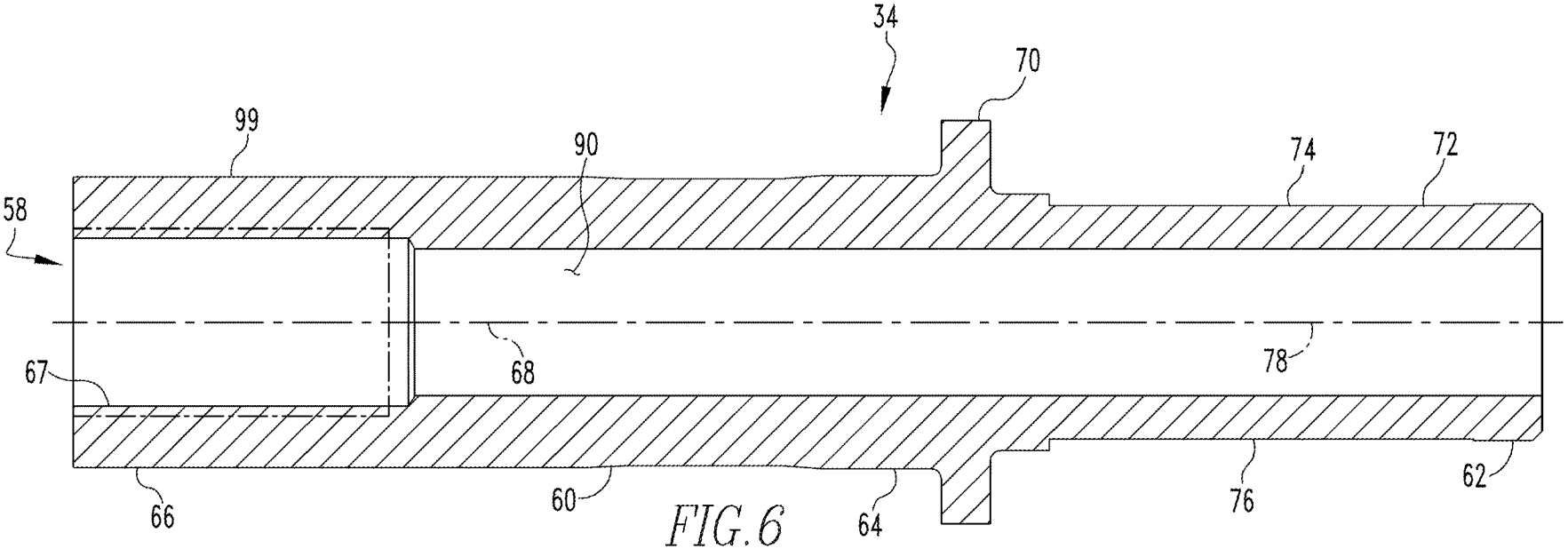
FIG. 6 is a cross-sectional side view of one embodiment of a punch mounting assembly.
Figure 7:
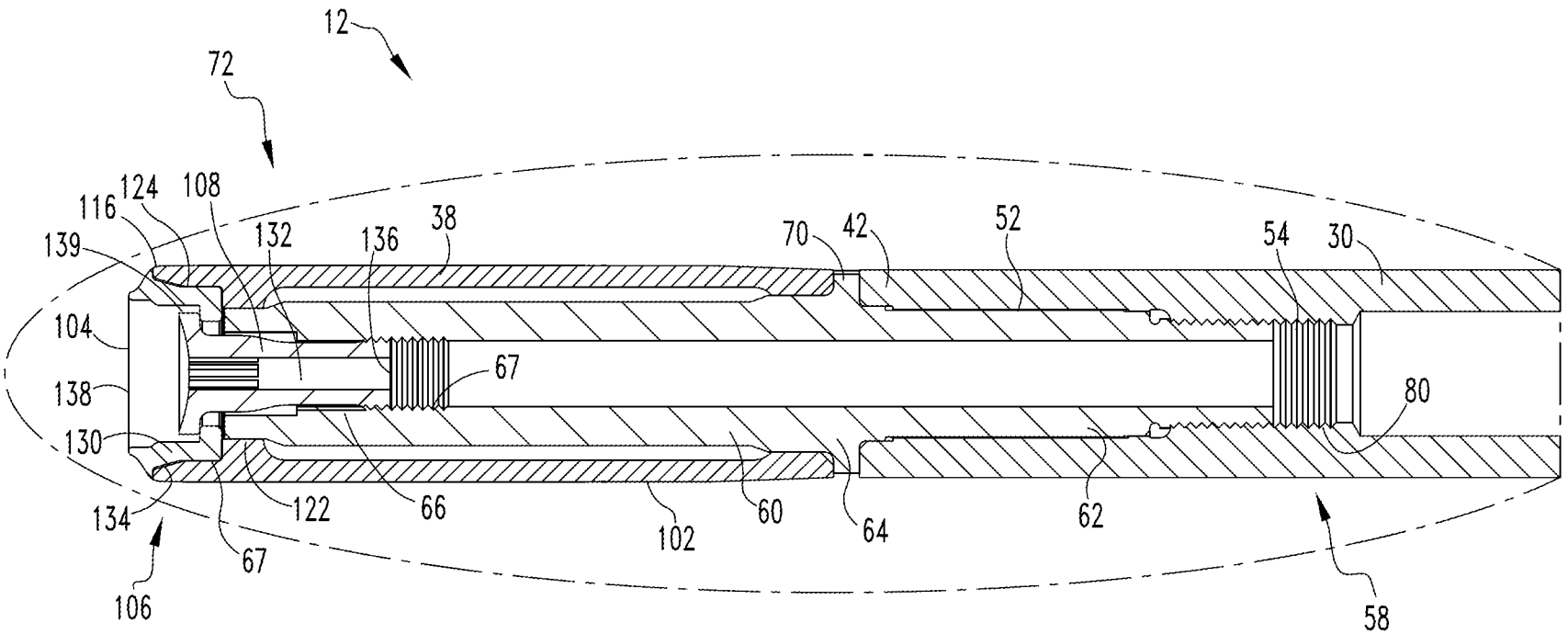
FIG. 7 is a cross-sectional side view of a ram assembly second end with another embodiment of the punch mounting assembly.
Figure 8:
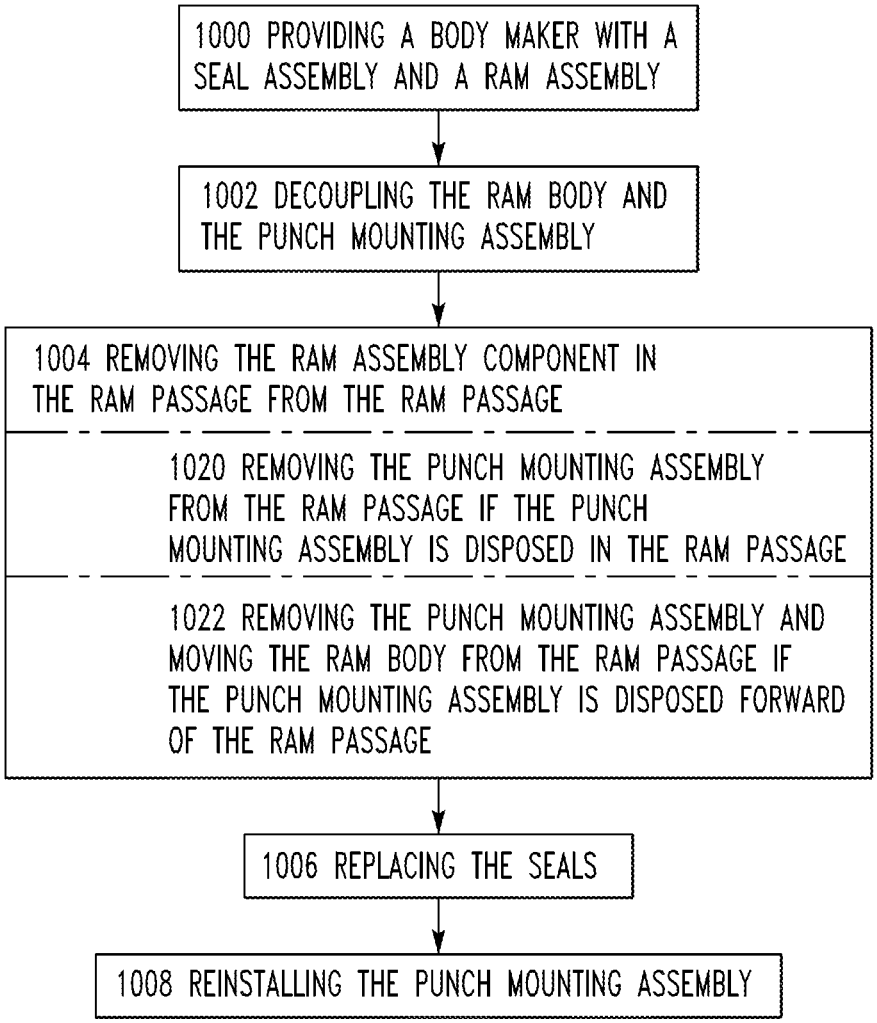
FIG. 8 is a flowchart of the disclosed method.

Further, as shown in FIG. 7, in one exemplary embodiment, punch mounting assembly second coupling component 72 also includes external threads 80 structured to be, and are, coupled to the ram body second end threaded bore 54. The punch mounting assembly second coupling component external threads 80 are disposed distal to the landing 76. In another exemplary embodiment, as shown in FIGS. 3-4 and 6, the punch mounting assembly second coupling component 72 also includes a longitudinal coupling bore 90 and a punch retainer bolt 132, discussed below. In this embodiment, the longitudinal coupling bore 90 is also the punch first coupling component 58. Further, in this embodiment, the punch retainer bolt 132 is identified as part of the punch mounting assembly second coupling component 72 as well as the punch second coupling component 106, discussed below. The punch mounting assembly second coupling component longitudinal coupling bore 90 extends through the punch mounting assembly body 60 generally along the punch mounting assembly body longitudinal axis 68. As discussed below, the punch retainer bolt 132 extends through the longitudinal coupling bore 90 and threadably engages the ram body second end threaded bore 54.

The punch mounting assembly body second end 66 includes a radial contour 99 that is structured to, and does, support the punch assembly 38. In this embodiment, the radial contour 99 is substantially circular. It is understood that in another embodiment where the elements are not substantially circular, the "radial" contour is one of a "perimeter" contour shaped to correspond to the shape of the punch assembly or a generally circular "radial" contour. Further, in one embodiment, wherein the punch mounting assembly second coupling component includes external threads 80, the punch mounting assembly body second end 66 is generally solid and includes an axial threaded bore 67 (FIG. 7) that extends along the punch mounting assembly body longitudinal axis 68. In this embodiment, the threaded punch mounting assembly body second end threaded bore 67 is part of the punch first coupling component 58. Thus, the punch first coupling component 58 is disposed at the punch mounting assembly body second end 66.

The punch assembly 38 includes a body 102 and a retainer assembly 104. The punch assembly body 102 is hollow and, in an exemplary embodiment, generally cylindrical having an inner radius sized to generally correspond to the outer surface of the punch mounting assembly body second end 66, i.e., the radial contour 99. In an exemplary embodiment, the punch assembly body 102 is a unitary body. In this configuration, the punch assembly body 102 does not have elements that are coupled to each other. As a unitary body, the punch assembly body 102 does not have separate portions that must be aligned and oriented relative to each other. Thus, use of a unitary punch assembly body 102 solves the problems noted above. The punch assembly body 102 includes a first end 112 and a second end 114. The punch assembly body first end 112 is structured to, and does, abut the punch mounting assembly body medial portion flange 70. The punch assembly body second end 114 defines all, or part of, a forming contour 120. As is known, the punch assembly body forming contour 120 is structured to form a selected profile in the cup bottom when the ram assembly 12 is immediately adjacent the domer assembly 18. Further, in an exemplary embodiment, an inner surface 124 of the punch assembly body second end 114 is tapered and/or includes steps with a decreasing radius. The punch assembly body second end 114 defines the punch assembly hollow 108, discussed below. The punch assembly body 102 also includes an inwardly extending flange 122 (FIG. 7) disposed adjacent, but spaced from, the punch assembly body second end 114. The punch assembly body flange 122 is structured to be, and is, engaged by the punch assembly retainer assembly 104.

The punch assembly body 102 is disposed over the punch mounting assembly body second end 66, i.e., the radial contour 99. Further, when the punch assembly body 102 is disposed on the punch mounting assembly body second end 66, a punch assembly body distal portion 116 extends beyond, i.e., forward of, the punch mounting assembly body second end 66. In this configuration, there is a punch assembly hollow 108.

The punch assembly retainer assembly 104 is a punch second coupling component 106. Stated alternately, all elements of the punch assembly retainer assembly 104 are elements of the punch second coupling component 106. The punch assembly retainer assembly 104 includes a retainer member 130 and a retainer bolt 132. The retainer member 130, as shown, is a toroid body sized to correspond to the inner surface of the punch assembly body second end 114 and may define all, or part of, the punch assembly body forming contour 120. In an exemplary embodiment, an outer surface 134 of the retainer member 130 is tapered and/or includes steps with a decreasing radius. That is, an outer surface of the retainer member 130 generally corresponds to the punch assembly body second end inner surface 124. The retainer member 130 is further structured to, and does, engage the punch assembly body flange 122. The retainer bolt 132 includes a wide, first end 136 and a threaded second end 138. The retainer bolt first end 136 is sized and shaped to generally correspond to a retainer member inner surface 139.

In one embodiment, wherein the punch mounting assembly second coupling component includes external threads 80, the retainer bolt second end 138 corresponds to the punch mounting assembly body second end axial threaded bore 67. Further, in this embodiment, the retainer bolt 132 has a length the extends generally from the punch assembly hollow 108 to the punch mounting assembly body second end threaded bore 67 when the punch assembly body 102 is installed. In this configuration, when the punch assembly body 102 is disposed over the punch mounting assembly body second end 66, the retainer member 130 is disposed in the punch assembly hollow 108 with the retainer member outer surface 134 coupled or directly coupled to the punch assembly body second end inner surface 124. Further, the retainer bolt 132 is passed through the retainer member 130 with the retainer bolt first end 136 coupled or directly coupled to the retainer member inner surface 139. Further, the retainer bolt second end 138 is threaded into the punch mounting assembly body second end threaded bore 67. As the retainer bolt 132 is drawn into the punch mounting assembly body second end threaded bore 67, the retainer bolt first end 136 engages the retainer member inner surface 139. This engagement causes the retainer member 130 to engage the punch assembly body 102 and biases the punch assembly body 102 rearwardly and against the punch mounting assembly body medial portion flange 70. This fixes the punch assembly body 102 to the punch mounting assembly 34. In an embodiment wherein the punch mounting assembly second coupling component 72 includes a longitudinal coupling bore 90, the retainer bolt 132 has a length sufficient to extend through the punch mounting assembly body 60. As used herein, a retainer bolt 132 with such a length is an "extended length retainer bolt" 132. Further, as used herein, an "extended length retainer bolt" 132 is not a "fastener" as defined above.

In this configuration, the punch assembly body 102 and the retainer member 130, as well as the punch mounting assembly 34, are coupled to the ram assembly body 30 by a single coupling component, the retainer bolt 132 engaging the ram body second end threaded bore 54. Thus, the punch assembly 38 and/or the punch mounting assembly 34 are coupled to the ram assembly body 30 by one of a "limited number of coupling components" or a "very limited number of coupling components." As used herein, a "limited number of coupling components" means less than five coupling components. As used herein, a "very limited number of coupling components" means less than three coupling components. For the definitions in this paragraph, an opening/passage through which a coupling passes is not considered to be a coupling component. Using a "limited number of coupling components" or a "very limited number of coupling components" to the punch assembly 38 and/or the punch mounting assembly 34 to the ram assembly body 30 solve the problems stated above. Further, in an exemplary embodiment, the punch assembly 38 and/or the punch mounting assembly 34 are not coupled to the ram assembly body 30 by "fasteners."

In this embodiment, rather than being threaded onto the punch mounting assembly body second end threaded bore 67, the retainer bolt 132 extends through the punch mounting assembly body 60 and the retainer bolt second end 138 is threaded into ram body second end threaded bore 54. The other portions of the punch assembly retainer assembly 104 are similar to, and act in a manner similar to, the embodiment described above. Thus, the punch assembly 38 is coupled, directly coupled, or fixed to the punch mounting assembly 34. The punch mounting assembly 34 is coupled, directly coupled, or fixed to the ram body 30. The ram body 30 is coupled to the drive assembly 14.

As is known, in each cycle the cup feeder 20 positions a cup 2 in front of the die pack 16 with the open end facing the ram assembly 12. When the cup 2 is in position in front of the die pack 16, the redraw assembly 15, biases the cup 2 against a redraw die (not shown). The drive assembly 14 provides a reciprocal motion to the ram body 30 causing the ram body 30 to move back and forth along its longitudinal axis 44. That is, the ram body 30 is structured to reciprocate between a retracted, first position and an extended, second position. In the retracted, first position, the ram assembly 12 is spaced from the die pack 16 but extends through the seal assembly 13. In the second, extended position, the ram assembly body 30 extends through the die pack 16. Thus, the reciprocating ram assembly 12 advances forward (to the left as shown) passing through the redraw assembly 15 and engages the cup 2. The cup 2 is moved through the redraw die (not shown) and a number of ironing dies (not numbered) within the die pack 16. The cup 2 is converted into a can body 3 within the die pack 16. As the ram assembly 12 moves toward the first position, i.e., as the ram assembly 12 moves toward the drive assembly 14, the stripper assembly 22 removes the can body 3 from the punch assembly 38. The stripper assembly 22 is structured to, and does, remove a can body 3 from the punch assembly 38 on the return stroke. The take-away assembly 24 is structured to, and does, operatively engage the can body 3 once, i.e., essentially simultaneously, it is removed from the punch assembly 38. The take-away assembly 24 removes the can body 3 from the path of the ram assembly 12. It is understood that, as used herein, a "cycle" means the cycle of the ram assembly 12 which begins with the ram assembly 12 in the retracted, first position.

Thus, the ram body 30 has a reduced length or a very reduced length. The punch mounting assembly 34 has a complementary length. The ram body 30 is coupled, directly coupled, or fixed to the punch mounting assembly 34 wherein the assembled punch mounting assembly 34 and ram body 30 have an operational length. In this configuration, the ram assembly 12 operates as a traditional ram assembly. That is, in operation, the ram assembly 12 extends through the seal assembly seals 19 and, when in the first position, the ram assembly 12 extends into the forward assemblies 26. When the seal assembly seals 19 need replaced, the ram assembly 12 is partially disassembled. That is, the punch mounting assembly 34 is decoupled from the ram body 30. When the ram body 30 has a reduced length, the portions of the ram assembly 12 coupled to the drive assembly 14 no longer extend into the forward assemblies 26. Thus, the seal assembly 13 can be decoupled from the guide assembly 28 and moved off the ram body 30. Once off the ram body 30, the seal assembly seals 19 are replaced. Then, the seal assembly 13 is positioned on the ram body 30, i.e., the ram body is positioned through the seal assembly seals 19, and the seal assembly 13 is coupled to the guide assembly 28. Then, the punch mounting assembly 34 is recoupled to the ram body 30. The ram assembly 12 is then ready for use. Thus, because the ram assembly 12 does not have to be decoupled from the drive assembly 14, the ram assembly does not have to be realigned with the forward assemblies 26. When the ram body 30 has a very reduced length, the procedure is similar except the seal assembly 13 is not removed from the guide assembly 28. Thus, the ram body 30 with a reduced length or a very reduced length and a punch mounting assembly 34 with a complementary length solve the problems stated above. Further, because the landing 76 and the landing bore 52 do not require alignment when coupled, the landing 76 and the landing bore 52 also solve the problems stated above.

Accordingly, a method of replacing seals 19 in a bodymaker seal assembly 13 includes: providing 1000 a bodymaker with a seal assembly and a ram assembly, the ram assembly including a ram body and a punch mounting assembly, the ram body having a reduced length, the punch mounting assembly having a complementary length, the punch mounting assembly coupled to the ram body wherein the assembled punch mounting assembly and ram body have an operational length, the seal assembly defining a passage, the seal assembly including a number of generally toroidal seals, the seals disposed in the seal assembly passage, the seals defining a ram passage, the ram assembly extending through the ram passage, decoupling 1002 the ram body and the punch mounting assembly, removing 1004 the ram assembly component in the ram passage from the ram passage, replacing 1006 the seals, and reinstalling 1008 the punch mounting assembly. Further, as used herein "replacing 1006 the seals" means removing the seals 19 in the seal assembly 13 and installing new seals 19 in the seal assembly 13. Further, as used herein, "reinstalling 1008 the punch mounting assembly" means coupling the punch mounting assembly 34 to the ram body 30.

Further, as detailed above, the ram assembly 12 does not need to be realigned with the forward components 26. Thus, reinstalling 1008 the punch mounting assembly does not include realigning the ram assembly relative to a number of forward assemblies.

Further, as used herein, "removing 1004 the ram assembly component in the ram passage from the ram passage" means removing the punch mounting assembly 34 when the ram body 30 has a reduced length, and, moving the seal assembly 13 from the ram body 30, or, removing the punch mounting assembly 34 when the ram body has a very reduced length. In either situation, no part of the ram assembly 12 extends through the ram passage or the seal assembly 13/seal assembly seals 19. Thus, removing 1004 the ram assembly component in the ram passage from the ram passage includes one of removing 1020 the punch mounting assembly from the ram passage, if the punch mounting assembly is disposed in the ram passage; and removing 1022 the punch mounting assembly and moving the ram body from the ram passage, if the punch mounting assembly is disposed forward of the ram passage.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A bodymaker for processing a cup into a can body, said bodymaker comprising:

a ram assembly reciprocating between a retracted, first position and an extended, second position;

a drive assembly for driving the ram assembly;

a domer assembly;

a seal assembly removing lubricant and cooling fluid from said ram assembly as said ram assembly reciprocates;

a die pack and a redraw assembly located between said domer assembly and said seal assembly; and a cup feeder positioning said cup in front of said die pack with an open end of said cup facing said ram assembly, wherein said ram assembly has an elongated ram body coupled to said drive assembly, a punch assembly positioned toward said domer assembly, and a punch mount assembly removably supporting said punch assembly, wherein:

said punch assembly is generally cylindrical;

said punch mount assembly comprises a flange and a first cylindrical portion and a second cylindrical portion extending in opposite directions from said flange;

said first cylindrical portion is inserted into a landing bore formed in said ram body;

said punch assembly is disposed on an outside of said second cylindrical portion;

said landing bore is connected to a threaded bore;

a punch retainer bolt is inserted through said second cylindrical portion into said punch mount assembly; and one end of said punch retainer bolt is screwed with said threaded bore.

2. The bodymaker of claim 1 wherein:

one end of said punch assembly extends from said second cylindrical portion along a longitudinal direction of said punch mount assembly;

at said one end of said punch assembly, a generally toroidal retainer member is positioned such that the retainer member is fitted into said punch assembly and penetrated by said punch retaining bolt;

an outer surface of said retainer member is configured to engage with one end face of said punch assembly; and another end of said punch retainer bolt is engaged with an inner surface of said retainer member.

3. The bodymaker of claim 2 wherein:

said retainer member engages a flange extending inwardly from an inner surface of said punch assembly.

4. The bodymaker of claim 2 wherein:

said retainer member defines all or part of a forming contour of said punch assembly.

5. The bodymaker of claim 1 wherein:

one end of said punch assembly extends from said second cylindrical portion along a longitudinal direction of said punch mount assembly;

at said one end of said punch assembly, a generally toroidal retainer member is fitted into said punch assembly;

an outer surface of said retainer member is configured to engage with one end face of said punch assembly.

6. The bodymaker of claim 5 wherein:

said retainer member engages a flange extending inwardly from an inner surface of said punch assembly.

7. The bodymaker of claim 5 wherein:

said retainer member defines all or part of a forming contour of said punch assembly.

8. The bodymaker of claim 3 wherein:

said retainer member defines all or part of a forming contour of said punch assembly.

9. The bodymaker of claim 6 wherein:

said retainer member defines all or part of a forming contour of said punch assembly.

* * * * *